United States Patent [19]

Engelhardt et al.

[11] 4,275,497

[45] Jun. 30, 1981

[54] SHAVING APPARATUS

[75] Inventors: Manfred Engelhardt; Jan Reinink; Jochem J. De Vries; Ferdinand M. Trees; Eduard W. Tietjens; Gerrit J. Groothuis, all of Drachten, Netherlands

[73] Assignee: U.S. Philips Corporation, New York, N.Y.

[21] Appl. No.: 72,256

[22] Filed: Sep. 4, 1979

[30] Foreign Application Priority Data

Sep. 21, 1978 [NL] Netherlands ..... 7809603

[51] Int. Cl.[3] ..... B26B 19/14

[52] U.S. Cl. ..... 30/43.6; 30/346.51; 30/34.2

[58] Field of Search ..... 30/34.2, 50, 43.4–43.6, 30/43.92, 346.51

[56] References Cited

U.S. PATENT DOCUMENTS

| | | | |
|---|---|---|---|
| 2,280,836 | 4/1942 | Moskovics | 30/43.6 |
| 2,288,162 | 6/1942 | Hulst | 30/34.2 |
| 3,088,205 | 5/1963 | Ellis | 30/34.2 X |
| 3,710,442 | 1/1973 | Meyer | 30/43.6 |
| 3,962,784 | 6/1976 | Tietjens | 30/43.6 |
| 4,044,463 | 8/1977 | Tietjens | 30/34.2 |
| 4,151,645 | 5/1979 | Tietjens | 30/43.6 |

FOREIGN PATENT DOCUMENTS

| | | | |
|---|---|---|---|
| 1094500 | 5/1955 | France | 30/346.51 |

*Primary Examiner*—Gary L. Smith

*Attorney, Agent, or Firm*—Thomas A. Briody; William J. Streeter; Rolf E. Schneider

[57] ABSTRACT

There is provided a shaving apparatus comprising a shear plate having hair entry apertures and a cutting unit associated with and drivable relative to the shear plate. The cutting unit comprises a cutting member having cutters extending toward the shear plate and respectively associated lead cutters movable relative to the cutters away from and toward the shear plate. The arrangement is such that each lead cutter is always maintained spaced from its associated cutter throughout their respective lengths regardless of their relative position.

5 Claims, 10 Drawing Figures

SHAVING APPARATUS

This invention relates to a shaving apparatus having a shear plate provided with hair entry apertures and a cutting unit which is drivable relative to the shear plate, which cutting unit comprises a cutting member provided with cutters, each cutter having a cutting edge at the end which faces the shear plate, and which cutting unit is equipped with lead cutters which are movable relative to the cutters, each lead cutter being provided with an edge which is situated near the cutting edge of its associated cutter.

Such a shaving apparatus is for example known from U.S. Pat. No. 3,962,784. In this known construction the lead cutter lies fully against an inclined cutter surface. During the hair pulling movement of the lead cutter the latter also remains in contact with the inclined surface. The disadvantage of this construction is that there is constantly friction between the lead cutter and the associated cutter. Moreoever, if contaminants such as hair cuttings get between the cutter and the lead cutter, the mobility of the lead cutter relative to the cutter is likely to be impaired or even destroyed. This result has an adverse effect on the operation of the shaving apparatus.

The construction of a shaving apparatus in accordance with the present invention, whose object it is to eliminate this disadvantage, is characterized in that each lead cutter is movable relative to its associated cutter in directions respectively away from and toward the shear plate, the lead cutter always being spaced from the associated cutter.

An embodiment of the shaving apparatus in accordance with the invention is characterized in that each lead cutter is pivotal relative to its associated cutter.

Preferably, the pivot of each lead cutter is situated ahead of the edge of the lead cutter, viewed in the direction of movement of the cutting unit.

A further embodiment is characterized in that the cutting unit includes a resilient element, by means of which the lead cutter is urged in the direction of the shear plate. As a result of this the lead cutter returns to the shear plate immediately after the hair-pulling movement.

A special embodiment is characterized in that each lead cutter is connected to a central body by means of an arm and that there is formed a constriction between the lead cutter and the arm, which constriction functions as a pivot.

The invention will now be described in detail with reference to the accompanying drawings, in which.

Figure 1:
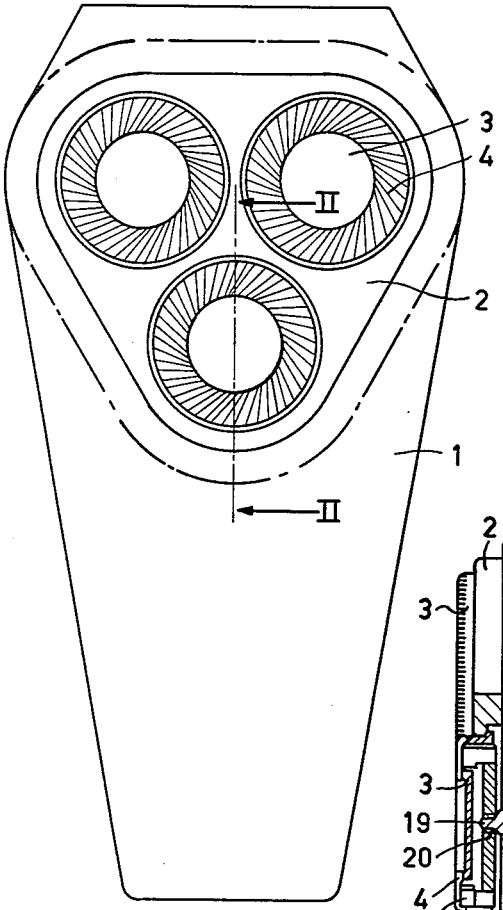
FIG. 1 is an elevation of a shaving apparatus having three shear plates.
Figure 2:
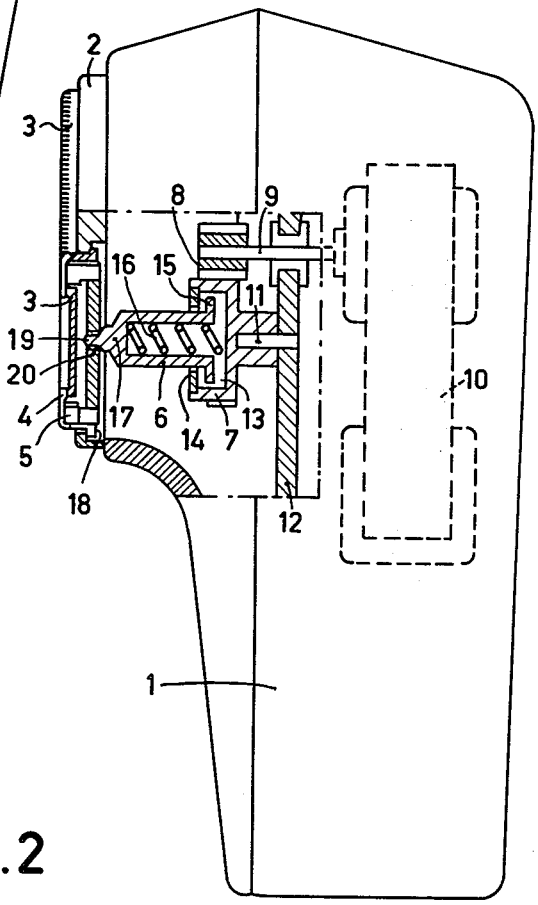
FIG. 2 shows the shaving apparatus of FIG. 1 in side view and partly in a cross-sectional view taken on the line II—II in FIG. 1.

The shaving apparatus in accordance with FIGS. 1 and 2 comprises a housing 1, of which a part takes the form of a shear plate holder 2 for three shear plates 3. The shear plates 3 are formed with hair entry apertures 4.

As shown in FIG. 2 a cutting unit 5 is situated on the inner side of a shear plate 3. This cutting unit 5, which for the sake of clarity is only shown schematically in FIG. 2, comprises a cutting member and lead cutters and is shown in detail and on an enlarged scale in FIG. 3.

The cutting unit 5 is coupled to the electric motor 10 by means of the hollow spindle 6 (FIG. 2), the gear wheels 7 and 8, and the spindle 9, so that the cutting unit is rotatable relative to the associated shear plate 3. The gear wheel 7 is rotatably journalled on a pin 11, which is mounted in the mounting plate 12. The gear wheel 7 has a recess 13, which is closed by a cover plate 14. This recess accommodates the flange 15 at the end of the hollow spindle 6. By giving the flange 15 a non-round, for example, square, shape and by shaping the recess 13 accordingly a coupling is obtained for the transmission of the rotary movement from the gear wheel 7 to the spindle 6. The spring 16, which for its greater part is situated in the hollow spindle 6 and which is tensioned between the hollow spindle 6 and the gear-wheel 7, exerts a force on the spindle 6 in the direction of the cutting unit 5. As the cylindrical portion 17 of the spindle 6 bears against the cutting unit 5, this force is exerted on the cutting unit and via the cutting unit on the shear plate 3, so that the shear plate is pressed against the shear plate holder 2 by means of its rim 18. As a result of external force, as may occur during use of the shaving apparatus, the shear plate 3 together with the cutting unit 5 and the spindle 6 can be pressed inwards against the action of the spring 16.

The coupling for the transmission of the rotary movement between the spindle 6 and the cutting unit 5 is obtained in that the spindle 6 is provided with an end 19 of rectangular cross-section. This end 19 engages with a corresponding rectangular coupling aperture 20 in the cutting unit 5.

The coupling to the electric motor 10 as described in the foregoing is identical for the three cutting units of the apparatus of FIGS. 1 and 2, the three gear wheels 7 being in engagement with a single centrally disposed gear wheel 8 on the motor spindle 9.

The cutting unit 5 (FIG. 3), shown schematically, comprises a cutting member 21 which is essentially constituted by a central body 22 which is provided with circumferential cutters 23 and in which moreoever the coupling aperture 20 is formed.

Each cutter 23 is provided with a lead cutter 24, which by means of a pivot 25 is pivotally connected to the cutter 23. Between a lead cutter 24 and a cutter 23 a clearance or space 26 exists. The lead cutters are preferably manufactured from a rigid sheet material.

Figure 4:
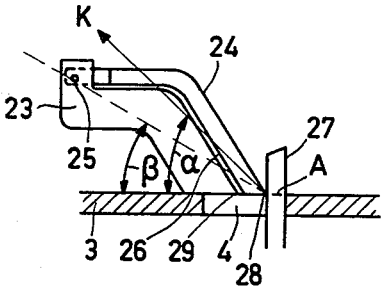
FIGS. 4 and 5 illustrate the operation of the lead cutter shown in FIG. 3.
Figure 5:
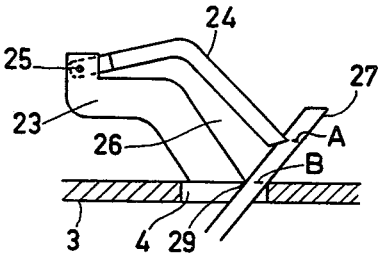

The operation of apparatus with the lead cutters in accordance with FIG. 3 will be explained with reference to FIGS. 4 and 5, which show a cutter 23 with its associated lead cutter 24 in side view and which show a part of the shear plate 3. When a hair 27 is caught in a hair entry aperture 4 this hair will soon come into contact with the sharp edge 28 of the lead cutter 24 at the location A (FIG. 4) as a result of the rotary movement of the cutter 23 and the lead cutter 24. The sharp edge 28 will then slightly penetrate the hair 27. The reaction force K which is exerted on the lead cutter 24 by the hair encloses an acute angle $\alpha$ with the shear plate 3. The force K causes the lead cutter 24 to pivot, so that the sharp edge 28 moves away from the shear plate 3. As a result of inter alia the natural elasticity of the skin the hair 27 is then moved along by the lead cutter 24 and assumes an oblique position until the cutting edge 29 of the cutter 23 has reached the hair at the location B (FIG. 5). Subsequently, the hair is cut off by co-operation of the shear plate 3 and the cutter 23. Thus, a length of the hair 27 will be cut which is greater by an amount equal to the distance between A and B than the length which would be cut without a lead cutter, so that a better shaving result is obtained.

It is obvious that the position of the pivot 25 should be selected so that the acute angle $\beta$ enclosed by the line which passes through the pivot 25 and the sharp edge 28 of the lead cutter and the shear plate 3 is smaller than the acute angle $\alpha$.

The clearance 26 between the cutter 23 and the lead cutter 24 should be so great as to prevent contaminants which could impair the movement of the lead cutter, from being collected therein.

Immediately after the cutting of a hair the lead cutter 24 should return to the shear plate 3. The lead cutter may then be urged against the shear plate by a resilient element (also see FIG. 9).

Figure 6:
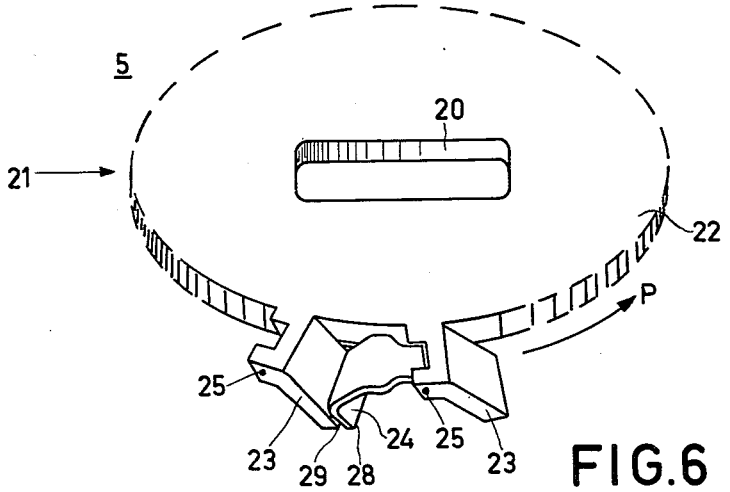
FIG. 6 shows a variant of the embodiment of FIG. 3 schematically and in perspective.

In the schematically represented embodiment of FIG. 6 the pivot 25 of the lead cutter 24, is situated in front of the sharp edge 28 of the lead cutter viewed in the direction of movement P of the cutting member 21. For this purpose each lead cutter 24 is pivotally coupled to the cutter 23 which precedes it viewed in the direction of movement.

Figure 3:
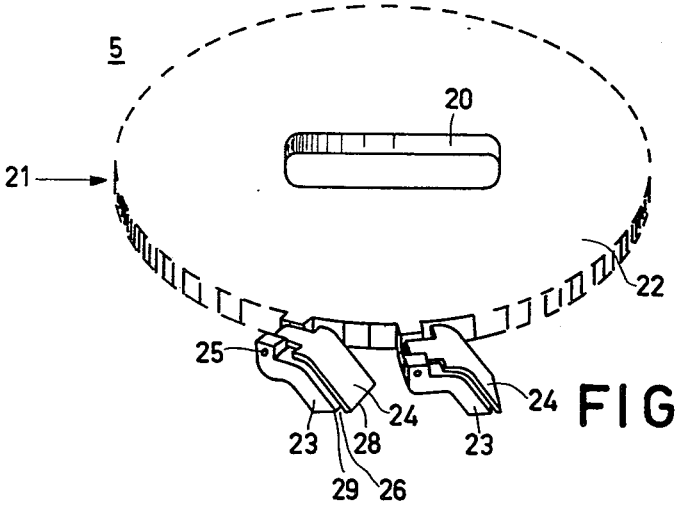
FIG. 3 shows on an enlarged scale the cutting member and the lead cutters schematically and in perspective.
Figure 7:
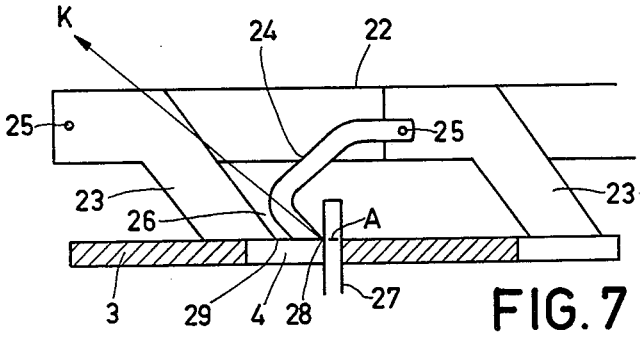
FIGS. 7 and 8 illustrate the operation of the lead cutter shown in FIG. 6.
Figure 8:
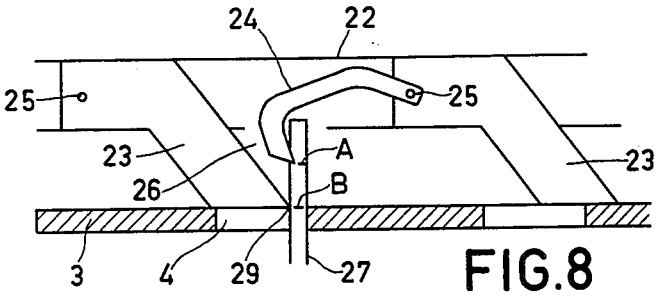

The operation of the apparatus in accordance with this embodiment is illustrated in FIGS. 7 and 8 and is analogous to that of the apparatus of FIG. 3. The reaction force K which is exerted on the lead cutter 24 by the hair, also causes a pivotal movement of the lead cutter 24, the hair being moved along until the cutting edge 29 of the cutter 23 has reached the hair at the location B (FIG. 8).

During the hair pulling movement of the lead cutter the clearance 26 between the cutter 23 and the lead cutter 24 should remain so great as to prevent contaminants in said clearance from impairing the movement of the lead cutter.

Figure 9:
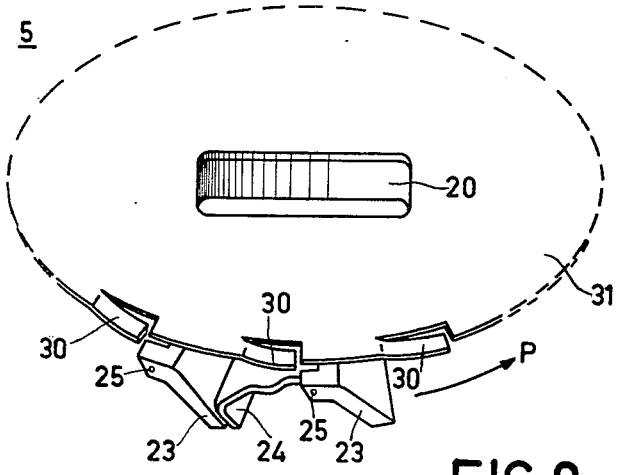
FIG. 9 shows the cutting member of FIG. 6, the lead cutters being urged into position by respective resilient elements.

The return of the lead cutter 24 to the shear plate 3 in this embodiment is obtained by means of a resilient element. Preferably, the resilient element consists of resilient tabs 30, which are formed from a disc 31 (FIG. 9). The resilient tab 30 urges its associated lead cutter 24 in the direction of the shear plate 3.

Figure 10:
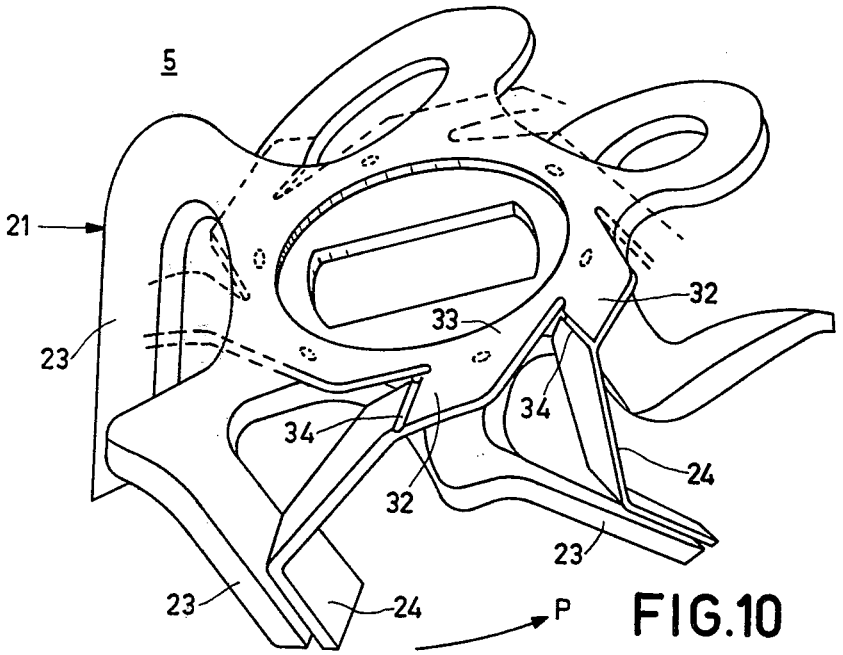
FIG. 10 shows on an enlarged scale a practical embodiment of the cutting member of FIG. 6.

A practical embodiment of the cutting unit 5 is shown in FIG. 10. The lead cutters 24 are connected to a central part 33 by means of arms 32, which part is secured to the central body 22 of the cutting member 21 for example by spot-welding. Between the lead cutter 24 and its arm 32 a constriction 34 is formed parallel to the sharp edge 28. This constriction functions as a pivot and also as a resilient element for the lead cutter.

The shaving apparatus as described in the foregoing, in which a clearance or space is maintained between the cutter and the lead cutter, may also be utilized in other types of shaving apparatus, such as for example vibratory shaving apparatus.

What is claimed is:

1. A shaving apparatus having a shear plate provided with hair entry apertures and a cutting unit associated with and drivable relative to the shear plate; said cutting unit comprising a cutting member, cutters extending from said cutting member toward the shear plate, lead cutters respectively associated with and movable relative to the cutters in directions respectively away from and toward the shear plate, and means to always maintain each lead cutter spaced from its associated cutter throughout their respective lengths regardless of their relative position.

2. A shaving apparatus according to claim 1, in which the space maintaining means comprises means to pivotally mount each lead cutter with respect to its associated cutter.

3. A shaving apparatus according to claim 2, in which the pivotal-mounting means for each lead cutter is positioned ahead of the edge of the lead cutter normally in contact with the shear plate viewed in the direction of movement of the cutting unit.

4. A shaving apparatus according to claim 3, in which the cutting unit includes a central body, and arms respectively connecting the lead cutters to the central body, the connection between each lead cutter and its associated arm comprising a constriction constituting said pivotal-mounting means.

5. A shaving apparatus according to claim 1, in which the cutting unit includes a resilient element urging the lead cutter in the direction toward the shear plate.

* * * * *